US009828890B2

(12) United States Patent
Jeon et al.

(10) Patent No.: US 9,828,890 B2
(45) Date of Patent: Nov. 28, 2017

(54) VALVE OPENING AND CLOSING APPARATUS

(71) Applicant: Hyundai Motor Company, Seoul (KR)

(72) Inventors: Jae Hee Jeon, Hwaseong-si (KR); Min Hui Yu, Hwaseong-si (KR); You Sang Son, Suwon-si (KR); Seock Joong Yoon, Hanam-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 125 days.

(21) Appl. No.: 14/928,693

(22) Filed: Oct. 30, 2015

(65) Prior Publication Data

US 2017/0002697 A1 Jan. 5, 2017

(30) Foreign Application Priority Data

Jul. 1, 2015 (KR) ..... 10-2015-0094060

(51) Int. Cl.

| | |
|---|---|
| ***F01L 1/18*** | (2006.01) |
| ***F01L 1/22*** | (2006.01) |
| ***F01L 1/26*** | (2006.01) |
| ***F01L 13/00*** | (2006.01) |

(52) U.S. Cl.

CPC ..... *F01L 1/181* (2013.01); *F01L 1/18* (2013.01); *F01L 1/22* (2013.01); *F01L 1/26* (2013.01); *F01L 1/267* (2013.01); *F01L 13/0026* (2013.01); *F01L 2001/186* (2013.01); *F01L 2105/00* (2013.01)

(58) Field of Classification Search

CPC ..... F01L 1/18; F01L 1/181; F01L 1/26; F01L 1/267; F01L 13/0026

USPC ..... 123/90.39, 90.44, 90.16

See application file for complete search history.

(56) References Cited

FOREIGN PATENT DOCUMENTS

| | | |
|---|---|---|
| JP | 53-044715 | 4/1978 |
| JP | 62-199913 | 9/1987 |
| JP | 04-339115 | 11/1992 |
| JP | 1997-105315 | 4/1997 |
| KR | 10-1998-0076672 | 11/1998 |
| KR | 10-2009-0064088 | 6/2009 |
| KR | 10-2009-0114217 | 11/2009 |

*Primary Examiner* — Ching Chang

(74) *Attorney, Agent, or Firm* — Brinks Gilson & Lione

(57) ABSTRACT

A valve opening and closing apparatus is disclosed having one or a plurality of rocker arms in contact with the cam, such that each of the rocker arms causes a valve to be opened and closed using the rotation of a cam. An eccentricity-creating unit is disposed on the rocker arm, and changes an eccentric position using rotation of a rotary shaft extending through the plurality of rocker arms. A driving unit is connected to the rotary shaft of the eccentricity-creating unit to rotate the rotary shaft.

16 Claims, 5 Drawing Sheets

VALVE OPENING AND CLOSING APPARATUS

CROSS REFERENCE TO RELATED APPLICATION

The present application claims the benefit of Korean Patent Application No. 10-2015-0094060, filed Jul. 1, 2015, which is incorporated herein by reference in its entirety.

FIELD

The present disclosure generally relates to a mechanical valve opening and closing apparatus having a cap and a locker arm that open and close a valve via which air is supplied to a cylinder.

BACKGROUND

The statements in this section merely provide background information related to the present disclosure and may not constitute prior art.

Typically, when an engine is operating, both air and fuel are supplied to a combustion chamber of a cylinder. Fuel is injected by an injector, while air is supplied to the combustion chamber through the operation of a cam and a valve provided in the cylinder head. At this time, it is required to adjust a point in time to open the valve, or the amount of the opening of the valve, depending on the operation area of the engine. In the related art, in order to blow air taken in by the cam and the valve into the combustion chamber, the valve disposed on the upper surface of the combustion chamber is opened and closed by the cam using a hydraulic circuit.

FIG. 1 illustrates a valve opening and closing apparatus of the related art. The valve opening and closing apparatus of the related art controls a point in time to open a valve 10 using a cam 20 and the amount of the opening of the valve 10 using a hydraulic circuit. However, the hydraulic circuit is composed of a plurality of parts, such as a pump unit 30, a high-pressure chamber 40, an accumulator 50, a deaerator 60, a pressure chamber 70, a check valve 80, a solenoid valve 90, and a brake unit 95, increasing the complexity, weight, and cost of the valve opening and closing apparatus of the related art. In addition, when a pressure-forming closed circuit has a large volume, the response of a hydraulic system becomes slow, degrading performance, which is problematic.

The foregoing is intended merely to aid in the understanding of the background of the present disclosure, and is not intended to mean that the foregoing is already known to those skilled in the art.

SUMMARY

The present disclosure to provides a valve opening and closing apparatus having a simplified configuration and a superior response rate, and being able to adjust the point in time to open a valve and the amount of the opening of the valve by controlling all of a plurality of locker arms without using a hydraulic mechanism.

According to one aspect of the present disclosure, there is provided a valve opening and closing apparatus including: a plurality of rocker arms each causing a valve to be opened and closed using rotation of a cam through contact with the cam; an eccentricity-creating unit disposed on the rocker arm, wherein the eccentricity-creating unit changes an eccentric position using rotation of a rotary shaft extending through the plurality of rocker arms; and a driving unit connected to the rotary shaft of the eccentricity-creating unit to rotate the rotary shaft.

The driving unit may be coupled to the rotary shaft to control all of the plurality of rocker arms.

The driving unit may include a plurality of gears and a motor.

The eccentricity-creating unit may include: eccentric cams rotatably disposed in a corresponding rocker arm of the plurality of rocker arms; and the rotary shaft eccentrically coupled to the eccentric cams. The eccentric position of the eccentric cams is adjusted following the rotation of the rotary shaft, thereby adjusting a degree to which the cams contact the corresponding rocker arm.

A rotary member may extend through and be coupled to one end portion of the corresponding rocker arm. A pressing part may be provided on the other end portion of the corresponding rocker arm such that the valve is to be pressed by the pressing part.

Each of the plurality of rocker arms may include: a body to which the eccentric cams are coupled; and an actuating part pressing the valve when pressed by the body. The body and the actuating part are coupled to each other by means of the rotary shaft of the actuating unit extending therethrough.

The body may include a front section, a rear section, and a connecting section. The front section and the rear section are symmetrical to each other. Each of the front section and the rear section has a through-hole in a central portion thereof to which a corresponding eccentric cam of the eccentric cams is coupled. Each of the front section and the rear section has a coupling hole in one portion and a pressing portion on the other portion. The pressing portion extends sideways from above the through-hole.

The actuating part may have a rotation hole in one portion thereof, through which the rotary shaft extends, and an extension on the other portion thereof, extending sideways from above the rotation hole. The pressing part is provided on the extension. The extension has support lugs protruding therefrom in a lateral direction.

The body may have through-holes in central portions to which the eccentric cams are coupled, coupling holes in predetermined portions, and pressing portions on the other portions. The actuating part may have a rotation hole in one portion and an extension on the other portion. The pressing part is provided on the extension. The body and the actuating part may be coupled to each other by means of the rotary shaft extending through the rotation hole. The pressing part may press the valve in response to the pressing portions pressing upon support lugs of the extension.

The actuating part may have a bearing on a portion of the actuating part corresponding to the rotary shaft.

Each of the eccentric cams may have a bearing coupled to the outer circumference thereof.

According to the valve opening and closing apparatus as described above and hereinbelow, unlike the related art in which the cam is mainly used to adjust the point in time in which the valve is to be opened and the amount of the opening of the valve, the eccentricity-creating unit having a simple configuration is provided on the rocker arms, such that the point in time in which the valve is to be opened and the amount of the opening of the valve can be precisely controlled depending on the driving areas of the engine. In addition, it is advantageously possible to control the eccentricity of all of the plurality of rocker arms, since the plurality of rocker arms are connected via the single rotary shaft and the rotary shaft is controlled using the driving unit.

In particular, since a hydraulic circuit having a complicated configuration can be omitted, the valve opening and closing apparatus has a simplified configuration and is reduced in weight and the number of components, thereby obtaining the effects of optimized fuel efficiency and reduced costs. In addition, since the valve opening and closing apparatus operates mechanically, the response rate thereof is improved compared to a hydraulic mechanism. Accordingly, the valve opening and closing apparatus has improved performance in low torque due to the improved response rate.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
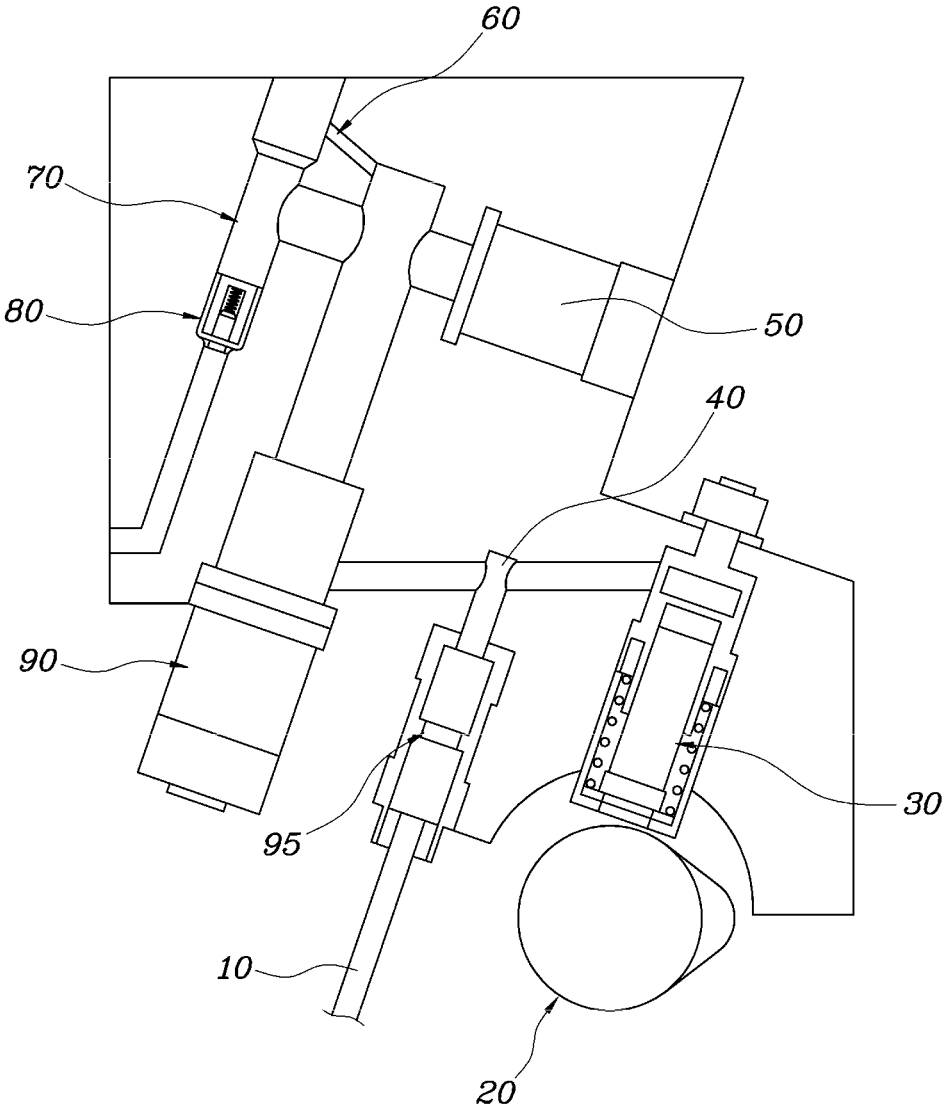
FIG. 1 Prior Art
FIG. 1 illustrates a valve opening and closing apparatus of the related art.

The drawings described herein are for illustration purposes only and are not intended to limit the scope of the present disclosure in any way.

DETAILED DESCRIPTION

The following description is merely exemplary in nature and is not intended to limit the present disclosure, application, or uses. Reference will now be made in greater detail to a valve opening and closing apparatus according to an embodiment of the present disclosure, an example of which is illustrated in the accompanying drawings. Wherever possible, the same reference numerals will be used throughout the drawings and the description to refer to the same or like parts.

Figure 2:
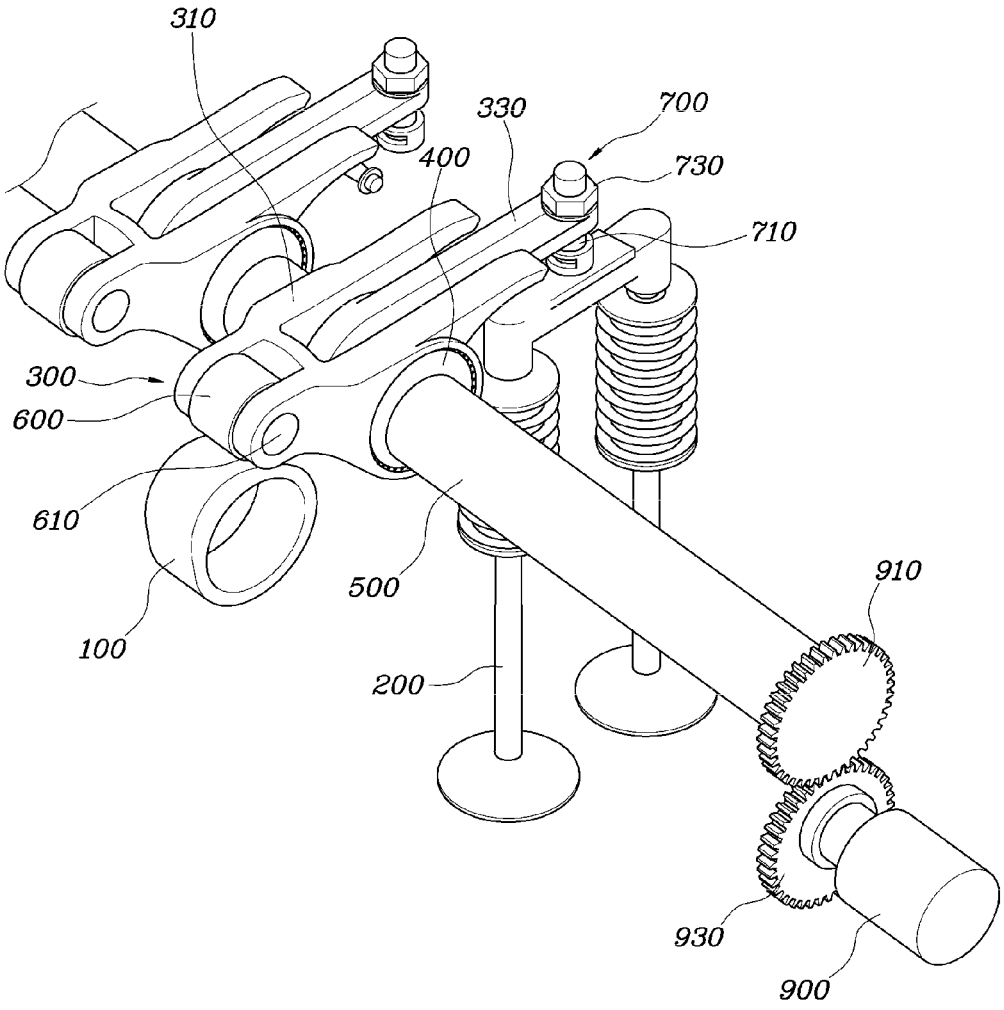
FIG. 2 is a perspective view illustrating a valve opening and closing apparatus according to an embodiment of the present disclosure.
Figure 3:
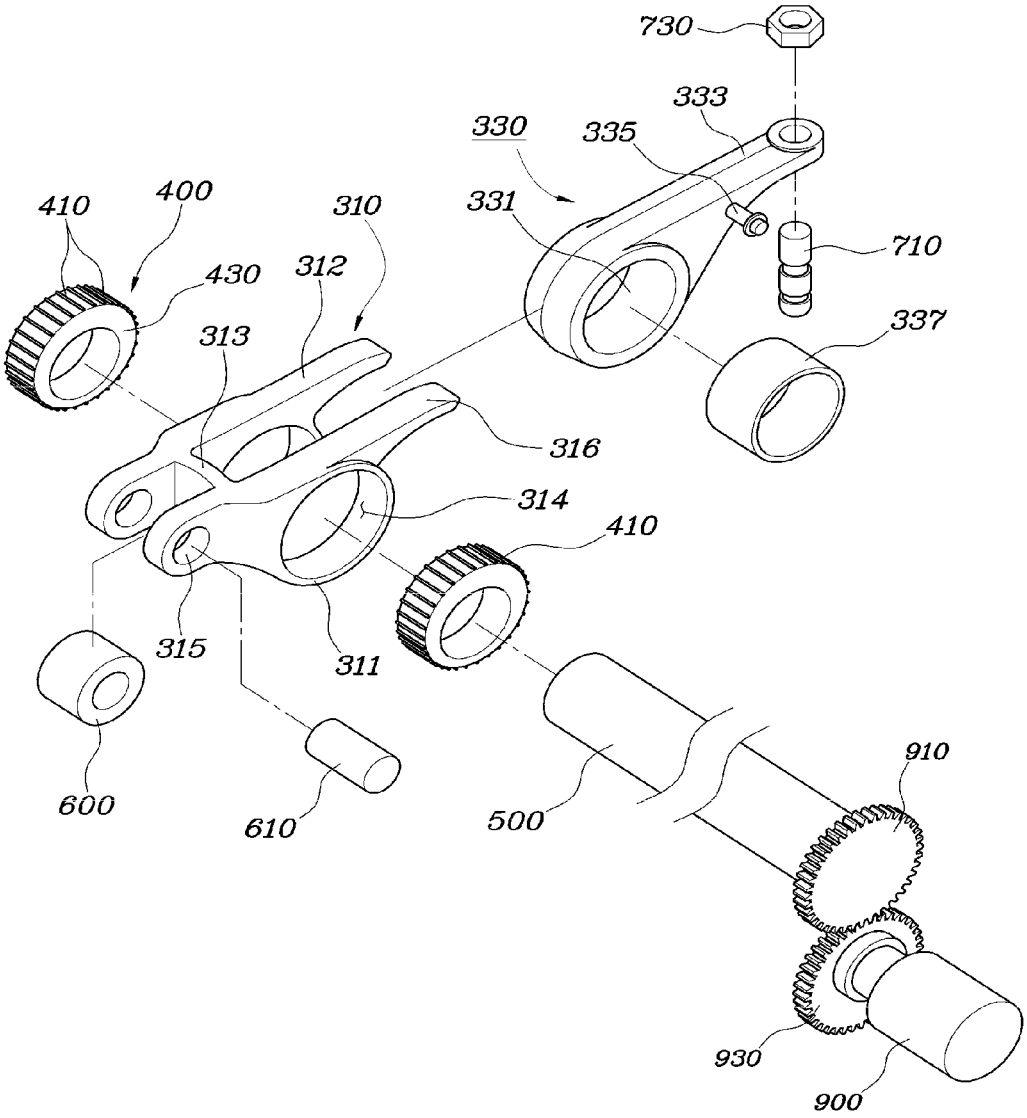
FIG. 3 is an exploded perspective view illustrating a rocker arm in FIG. 2.

As illustrated in FIGS. 2 and 3, the valve opening and closing apparatus according to the exemplary embodiment of the present disclosure includes a plurality of rocker arms 300, an eccentricity-creating unit 400, 500, and a driving unit 900, 910, and 930. Each of the plurality of rocker arms 300 comes into contact with a cam 100, allowing a valve 200 to be opened and closed through the rotation of the cam 100. The eccentricity-creating unit is provided on each of the plurality of rocker arms 300, and changes an eccentric position using the rotation of a rotary shaft 500 extending through the plurality of rocker arms 300. The driving unit 900, 910, and 930 are connected to the rotary shaft 500 of the eccentricity-creating unit, and enable the rotary shaft 500 to rotate.

The driving unit 900, 910, and 930 are coupled to one end portion of the rotary shaft 500 to control all of the plurality of rocker arms 300, although individual driving units could be used for each rocker arm 300. The driving unit 900, 910, and 930 include a plurality of gears 910 and 930 and a motor 900. When the motor 900 operates, the second gear 930 coupled to the motor 900 rotates. Following the rotation of the second gear 930, the first gear 910 coupled to one end portion of the rotary shaft 900 rotates, thereby adjusting the eccentricity of all of the plurality of rocker arms 300. Even in the case in which a plurality of intake valves or a plurality of exhaust valves are provided on a single cylinder, as in a double overhead camshaft (DOHC), the driving unit 900, 910, and 930 can advantageously adjust the eccentricity of all of the plurality of rocker arms 300 through a single operation thereof.

Although the driving unit 900, 910, and 930 are illustrated as including the motor 900, the first gear 910, and the second gear 930, this is not intended to be limiting. Since such a configuration or arrangement is correlated to the layout, the driving unit can be modified or changed depending on the environment or the design as long as the rotary shaft can be rotated thereby.

In addition, the eccentricity-creating unit 400 and 500 includes eccentric cams 400 and the rotary shaft 500. The eccentric cams 400 are rotatably disposed in the rocker arms 300, and the rotary shaft 500 is rotatably and eccentrically coupled to the eccentric cams 400. With this configuration, the eccentric position 430 (FIG. 3) of the eccentric cams 400 (i.e. the position of the eccentric portion of the cams 400) can be adjusted following the rotation of the rotary shaft 500, thereby adjusting the degree to which the cams 100 contact the corresponding rocker arm 300, as described further hereinbelow.

A rotary member 600 extends through and is coupled to one end portion of each of the rocker arms 300 via a pin 610, and a pressing part 700 is provided on the other end portion of each of the rocker arms 300. The rotary member 600 may be implemented as a roller. A point in time in which the valve 200 is opened and the amount of the opening of the valve 200 are determined by the correlation between the rotary member 600 and the cam 100, i.e. depending on the distance set between the center of the cam 100 and the center of the pin 610, which defines the center of rotation of the rotary member 600.

Therefore, according to the present disclosure, the point in time in which the valve 200 is opened and the amount of the opening of the valve 200 are variably controlled by adjusting the distance in the center between the cam 100 and the pin 610 by changing the eccentric position 430 of cams 400 in response to the rotation of the rotary shaft 500 of the eccentricity-creating unit 400 and 500. Since the pressing part 700 may be integrally formed on the corresponding rocker arm 300, the pressing part 700 may be implemented as a screw or the like. According to the present disclosure, the pressing part 700 is illustrated as including a screw or bolt 710 and a fastening member 730 such that the point in time in which the valve 200 is opened and the amount of the opening of the valve(s) 200 can be more precisely adjusted once again using the pressing part 700. The fastening member 730 is implemented as a nut, such that the screw 710 can be adjusted by the nut 730.

According to the present disclosure, the displacement of the rocker arm 300 is changed by the cam 100 as in a related-art valve opening and closing apparatus. In response to the changed displacement, the rocker arm 300 presses against or releases pressure from the valve 200, such that the valve 200 is opened or closed. Unlike the related-art valve opening and closing apparatus, which mainly uses the cam in order to change a point in time to open or close the valve, according to the present disclosure the rocker arm 300 is provided with the eccentricity-creating unit 400 and 500, such that the point in time in which the valve 200 is opened and the amount of the opening of the valve 200 can be can be mechanically varied using a simple configuration. Since the mechanism allowing the valve 200 to be opened and closed using the cam 100 is well known to a person skilled in the art, a detailed description thereof will be omitted.

In addition, the eccentricity-creating unit 400 and 500 may be provided on a rocker arm having a typical configuration, such that the eccentric position 430 of cams 400 can be adjusted through the rotation of the rotary shaft 500, thereby variably adjusting the point in time in which the valve 200 is opened and the amount of the opening of the valve 200. However, according to the embodiment of the present disclosure, the rocker arm 300 has been illustrated and described as having a body 310 and an actuating part 330.

As illustrated in FIGS. 2 and 3, the rocker arm 300 includes the body 310 to which the eccentric cams 400 are coupled, and the actuating part 330 opening the valve 200 when pressed by the body 310. The body 310 and the actuating part 330 are coupled to each other by means of the rotary shaft 500 extending therethrough. When the rotary shaft 500 rotates, the eccentric cams 400 rotate following the rotation of the rotary shaft 500, changing the eccentric position 430. This consequently changes the position in which the rocker arm 300 contacts the cam 100, thereby adjusting the point in time in which the valve 200 is opened and the amount of the opening of the valve 200.

As best seen in FIG. 3, the body 310 includes a front section 311, a rear section 312, and a connecting section 313. The front section 311 and the rear section 312 are formed symmetrical to each other, and a through-hole 314 is formed in each of the front section 311 and the rear section 312. Each of the front section 311 and the rear section 312 is a plate having a predetermined thickness, which is substantially reverse-triangular shaped. The front section 311 and the rear section 312 having the above-described configuration are maintained at a predetermined distance from each other by the connecting section 313 disposed between a pair of through-holes 314 and a pair of coupling holes 315 formed in predetermined portions of the body 310. The eccentric cams 400 are coupled to the through-holes 314. In addition, the body 310 has pressing portions 316 provided on the other portions thereof, extending sideways (projecting orthogonally, e.g. relative to an axis of the shaft 500 or the cam 100) from above the through-holes 314. The rotary member 600 is coupled to the coupling holes 315 via the pin 610, such that the rotary member 600 can transfer the rotating force of the cam 100 to the rocker arm 300 while rotatably supporting the cam 100.

In addition, the actuating part 330 has a rotation hole 331 in one portion thereof. The diameter of the rotation hole corresponds to, and is preferably sized larger than, the outer diameter of the rotary shaft 500, such that the rotary shaft 500 extends through the rotation hole 331. Thus, a bearing 337 can be provided in the portion of the rotation hole 331 corresponding to the rotary shaft 500. The bearing 337 enables the rotary shaft 500 to have smooth relative motion within the rotation hole 331. Although the bearing 337 may be omitted when the rotation hole 331 is formed of aluminum (Al), the bearing 337 is preferably used when the rocker arm 300 is formed of a cast iron or a forged iron or steel.

An extension 333 is provided on the other portion of the actuating part 330 (opposite the one portion having the rotation hole 331), extending sideways (or orthogonally) from above the rotation hole 331. The pressing part 700 is provided on the extension 333. The extension 333 has support lugs 335 protruding from the extension 333 in a lateral direction, i.e. from the right and left portions of the extension 333 (e.g. protruding forwardly/rearwardly). In particular, the support lugs 335 are formed in position corresponding to the pressing portions 316 of the body 335. When the pressing portions 316 press the support lugs 335, the actuating part 330 is actuated to press the valve 200. As illustrated in the drawings, the support lugs 335 may be integrally formed on the actuating part 330 by molding, shaping, or the like. Alternatively, the support lugs 335 may be formed separate pieces and subsequently coupled to a hole or recesses (not shown) formed in the rocker arm 300.

When the coupling relationship between the body 310 and the actuating part 330 is described in summary, the front section 311 and the rear section 312 of the body 310 are maintained at a predetermined distance from each other, and the eccentric cams 400 are coupled to the through-holes 314 formed in the front and rear sections 311 and 312. Bearings 410 may be coupled to the outer circumference of the eccentric cams 400 for smooth relative rotation of the eccentric cams 400. The bearings 410 may be needle bearings, which are disposed at predetermined distances along the outer circumference of the eccentric cams 400. On the other hand, like the bearings 337, the bearings 410 of the eccentric cams 400 may be omitted depending on the environment or the design.

After the actuating part 330 is fitted between the front section 311 and the rear section 312, the rotary shaft 500 sequentially extends through and is fitted into the eccentric cam 400 in the front section 331, the rotation hole 331 of the actuating part 330, and the eccentric cam 400 in the rear section 312. Therefore, when the rotary shaft 500 rotates, the eccentric cams 400 rotate, changing the eccentric position 430, whereby the position in which the rocker arm 300 (namely body 310 via rotatory member 600) contacts the cam 100 is changed. Consequently, in the state in which the position in which the rocker arm 300 contacts the cam 100 is changed, the support lugs 335 of the actuating part 330 are pressed by the pressing portions 316 of the body 310, thereby pressing the valve 200. In this manner, the point in time in which the valve 200 is opened and the amount of the opening of the valve 200 can be adjusted.

Although not illustrated in this disclosure, the rotary shaft 500 may be driven by a driving part (not shown) controlled by a controller (not shown). However, a person skilled in the art can make many modifications or alterations to this configuration without departing from the scope of the present disclosure.

An operation in response to eccentric variable control by the valve opening and closing apparatus will be described in greater detail with reference to FIGS. 4 and 5. In the following, the eccentric variable control is carried out by the operation of the motor 900 of the driving unit, under the control of a controller (not shown), such as an electronic control unit (ECU). More specifically, the eccentric control is enabled due to the rotation of the rotary shaft 500 following the rotation of the motor 900.

Figure 4:
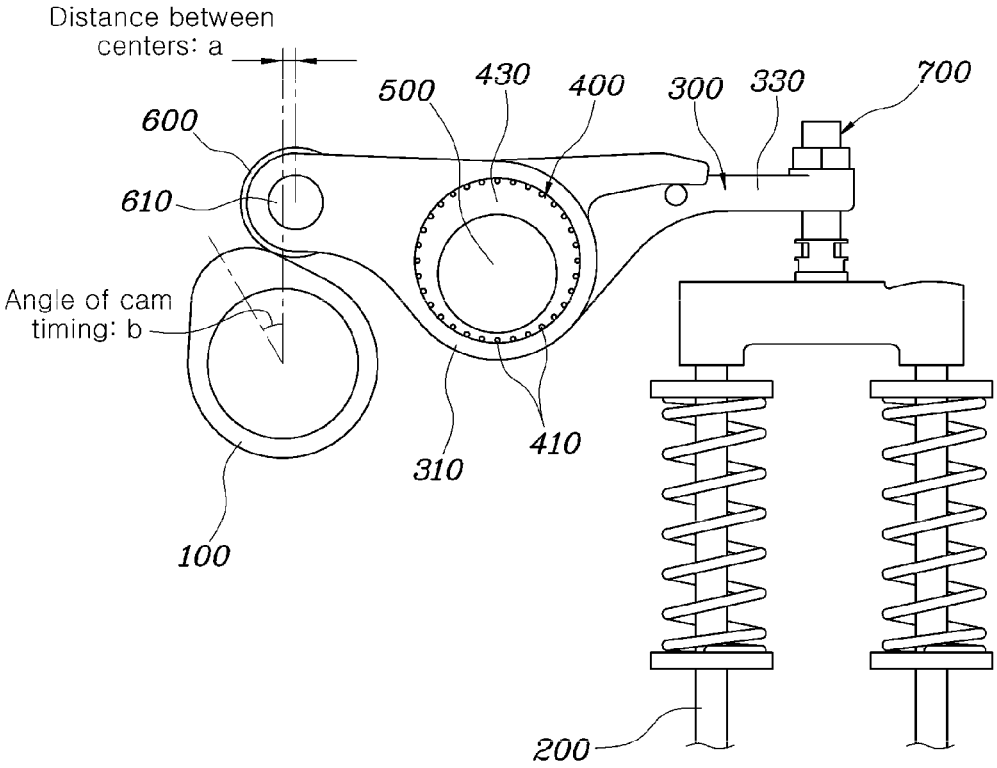
FIG. 4 illustrates a variable control-off state of the valve opening and closing apparatus of FIG. 2.

FIG. 4 illustrates a variable control-off state, in which eccentricity is not created in the rocker arm 300 since the eccentric position 430 formed by the eccentric cams 400 and the rotary shaft 500 are positioned at top points (up on the page in FIG. 4). Consequently, for the operation of opening and closing the valve 200, the distance from the center of the cam 100 to the center of the pin 610 of the rotary member 600 is set to "a" and the angle of timing at which the cam 100 opens and closes the valve 200 is set to "b".

Figure 5:
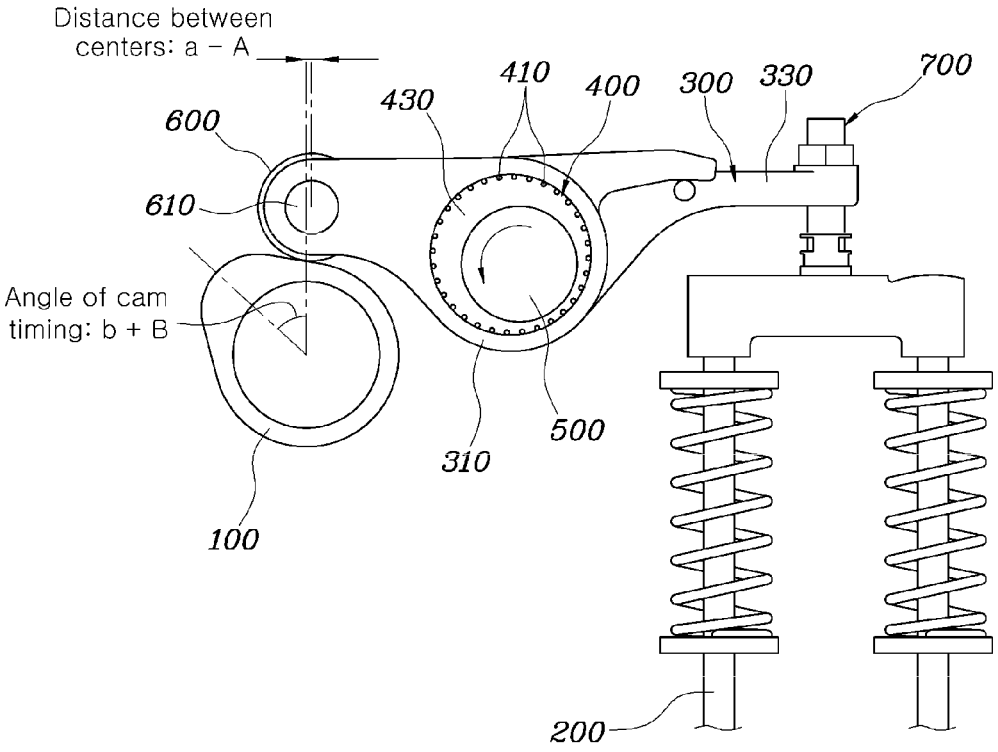
FIG. 5 illustrates a variable control-on state of the valve opening and closing apparatus of FIG. 2.

FIG. 5 illustrates one variable control-on state, in which the eccentric position 430 is moved in the direction of the cam 100 due to the rotation of the rotary shaft 500 in the counterclockwise direction indicated by an arrow. A camshaft (not shown), the center of the rotation of the cam 100, and the rotary shaft 500 of the eccentricity-creating unit 400 and 500 are fixed to an engine. Since the eccentric position 430 is displaced due to the rotation of the eccentric cams 400 caused by the rotary shaft 500, eccentricity occurs in the rocker arm 300. The rocker arm 300 is pressed in the direction of the top-left part (on the page of FIG. 5), and is brought into closer contact with the cam 100. Consequently, the distance between the center of the cam 100 and the center of the pin 610 of the rotary member 600 is set to a-A, which is reduced from the distance in the variable control-off state (the reduction being indicated by A), and the angle of timing at which the cam 100 opens and closes the valve 200 is set to an increased value of b+B (the increase being indicated by B), such that the valve 200 is opened at an earlier point in time.

Thus, when the angle of timing at which the cam 100 opens and closes the valve 200 is increased as in FIG. 5, the valve 200 is opened at the earlier point in time, whereby a point in time in which air starts to be taken in becomes earlier. At this time, the position in which the pressing part 700 contacts the valve 200 moves in an oblique direction, i.e. toward the top-left (up and left on the page in FIGS. 4 and 5), whereby the amount of the opening of the valve 200 can also be increased. Accordingly, when the engine is in a high-speed operation area or a low and medium-speed operation area, it is possible to carry out the above-described control operation such that the valve 200 is opened at an earlier point in time and the amount of the opening increases.

When the engine is in a low-speed operation area, the eccentric position 430 is controlled to be in a low-right position (down and right on the page in FIGS. 4 and 5) by rotating the rotary shaft 500 in the clockwise direction. Consequently, the timing in which the valve 200 is opened is delayed, and the amount of the opening of the valve 200 is reduced.

As described above, the valve opening and closing apparatus can mechanically vary the eccentric position 430 using the eccentricity-creating unit 400 and 500 having a simple configuration without a complicated configuration, such as a hydraulic circuit. It is therefore possible to set the point in time in which the valve is to be opened and the amount of the opening of the valve according to driving states, based on the cam profiles of the driving areas of the engine, thereby more precisely controlling the engine.

Unlike the related art in which the cam is mainly used to adjust the point in time in which the valve is to be opened and the amount of the opening of the valve, according to the valve opening and closing apparatus as described above, the eccentricity-creating unit having a simple configuration is provided on the rocker arms, such that the point in time in which the valve is to be opened and the amount of the opening of the valve can be precisely controlled depending on the driving areas of the engine. In addition, it is advantageously possible to control the eccentricity of all of the plurality of rocker arms, since the plurality of rocker arms are connected via the single rotary shaft and the rotary shaft is controlled using the driving unit.

In particular, since a hydraulic circuit having a complicated configuration can be omitted, the valve opening and closing apparatus has a simplified configuration and is reduced in the weight and the number of components, thereby obtaining the effects of optimized fuel efficiency and reduced costs. In addition, since the valve opening and closing apparatus operates mechanically, the response rate thereof is improved compared to a hydraulic mechanism. Accordingly, the valve opening and closing apparatus has improved performance in low torque due to the improved response rate.

Although the exemplary embodiments of the present disclosure have been described for illustrative purposes, those skilled in the art will appreciate that various modifications, additions and substitutions are possible, without departing from the scope and spirit of the present disclosure as disclosed in the accompanying claims.

What is claimed is:

1. A valve opening and closing apparatus for a valve operated by a cam, the valve opening and closing apparatus comprising:

a plurality of rocker arms each causing the valve to be opened and closed using rotation of the cam through contact with the cam;

an eccentricity-creating unit including eccentric cams and a rotary shaft, and connected to at least one rocker arm of the plurality of rocker arms, wherein the eccentricity-creating unit changes eccentricity of the at least one rocker arm relative to the cam using rotation of the rotary shaft extending through the at least one rocker arm; and a driving unit including a plurality of gears and a motor, and connected to the rotary shaft of the eccentricity-creating unit to rotate the rotary shaft.

2. The valve opening and closing apparatus according to claim 1, wherein the driving unit is coupled to the rotary shaft to control all of the plurality of rocker arms.

3. The valve opening and closing apparatus according to claim 1, wherein the eccentric cams are rotatably disposed in a corresponding rocker arm of the plurality of rocker arms; and the rotary shaft is coupled to the eccentric cams for rotation therewith, wherein an eccentric position of the eccentric cams is adjusted following the rotation of the rotary shaft, thereby adjusting a degree to which the eccentric cams contact the corresponding rocker arm.

4. The valve opening and closing apparatus according to claim 3, wherein a rotary member extends through and is coupled to a first end portion of the corresponding rocker arm, and a pressing part is formed on the corresponding rocker arm and is provided on a second end portion of the corresponding rocker arm opposite the first end portion such that the valve is to be pressed by the pressing part.

5. The valve opening and closing apparatus according to claim 4, wherein each of the plurality of rocker arms comprises:

a body to which the eccentric cams are coupled; and an actuating part coupled to the body and configured to press the valve when pressed on by the body, wherein the body and the actuating part are coupled to each other by means of the rotary shaft of the actuating unit extending therethrough.

6. The valve opening and closing apparatus according to claim 5, wherein the body comprises a front section, a rear section, and a connecting section, wherein the front section and the rear section are symmetrical to each other, each of the front section and the rear section having a through-hole in a central portion to which a corresponding eccentric cam is coupled, each of the front section and the rear section having a coupling hole in one portion and a pressing portion on another portion spaced opposite the one portion, the pressing portion extending orthogonally from above the through-hole.

7. The valve opening and closing apparatus according to claim 5, wherein the actuating part has a rotation hole in one portion thereof, through which the rotary shaft extends, and an extension on another portion thereof, extending orthogonally from above the rotation hole, wherein the pressing part is provided on the extension, and the extension has support lugs protruding therefrom in a lateral direction.

8. The valve opening and closing apparatus according to claim 5, wherein the body has through-holes in central portions to which the eccentric cams are coupled, coupling holes in predetermined portions, and pressing portions on other portions opposite the predetermined portions, wherein the actuating part has a rotation hole in one portion and an extension on another portion, the pressing part being provided on the extension, wherein the body and the actuating part are coupled to each other by means of the rotary shaft extending through the rotation hole, and wherein the pressing part presses the valve in response to the pressing portions pressing on support lugs of the extension.

9. The valve opening and closing apparatus according to claim 5, wherein the actuating part has a bearing on a portion of the actuating part corresponding to the rotary shaft.

10. The valve opening and closing apparatus according to claim 3, wherein each of the eccentric cams has a bearing coupled to an outer circumference thereof.

11. The valve opening and closing apparatus according to claim 1, wherein the eccentricity-creating unit is connected to all of the plurality of rocker arms.

12. The valve opening and closing apparatus according to claim 1, wherein the eccentricity-creating unit is directly connected to the plurality of rocker arms.

13. A valve opening and closing apparatus for a valve connected to a cylinder of an engine, the valve operated by a cam, the valve opening and closing apparatus comprising:

a rocker arm positioned to contact the cam to cause the valve to be opened and closed based on rotation of the cam, the rocker arm including a body and an actuating part, the actuating part connected to the body for rotation relative thereto, the body including a through-hole;

an eccentric cam disposed in the through-hole of the rocker arm for rotation within the through-hole, the rotational position of the eccentric cam relative to the body changing the position of the rocker arm relative to the cam; and a driving unit connected to the eccentric cam.

14. The valve opening and closing apparatus of claim 13, further comprising a rotary shaft connected to the cam for rotation therewith.

15. The valve opening and closing apparatus of claim 14, wherein the actuating part includes a rotation hole rotatably receiving the rotary shaft.

16. The valve opening and closing apparatus of claim 14, wherein a position of an axis of the rotary shaft relative to a position of an axis of the cam is fixed.

* * * * *